United States Patent [19]

Hyatt et al.

[11] 4,294,625

[45] Oct. 13, 1981

[54] ALUMINUM ALLOY PRODUCTS AND METHODS

[75] Inventors: Michael V. Hyatt, Bellevue; William E. Quist, Redmond, both of Wash.

[73] Assignee: The Boeing Company, Seattle, Wash.

[21] Appl. No.: 141,272

[22] Filed: Apr. 18, 1980

Related U.S. Application Data

[63] Continuation-in-part of Ser. No. 974,484, Dec. 29, 1978, abandoned.

[51] Int. Cl.[3] ..... C22F 1/04; C22C 21/16

[52] U.S. Cl. ..... 148/2; 75/141; 75/142; 148/3; 148/11.5 A; 148/12.7 A; 148/32; 148/32.5; 148/159

[58] Field of Search ..... 75/142, 141; 148/11.5 A, 12.7 A, 32, 32.5, 2, 3, 159

[56] References Cited

U.S. PATENT DOCUMENTS 3,826,688 7/1974 Levy ..... 148/11.5 A

*Primary Examiner*—R. Dean

*Attorney, Agent, or Firm*—Christensen, O'Connor, Johnson & Kindness

[57] ABSTRACT

A 2000 series aluminum alloy characterized by high strength, very high fatigue resistance, and very high fracture toughness consists essentially of 3.8% to 4.4% copper, 1.2% to 1.8% magnesium, 0.3% to 0.9% manganese, maximums of 0.12% silicon, 0.15% iron, 0.25% zinc, 0.15% titanium, 0.10% chromium, 0.05% of each of any other trace elements present, and a maximum total of such other trace elements of 0.15%, the balance of the alloy being aluminum. It is preferred, especially for plate products, that the maximum iron and silicon levels be restricted to 0.12% and 0.10%, respectively. For extruded products, the foregoing alloy is hot worked to yield a wrought product having a substantially unrecrystallized structure. For plate products, the alloy is subjected to room temperature preaging and a cold rolling treatment to provide a reduction in gauge of from 9% to 13%.

33 Claims, 8 Drawing Figures

ALUMINUM ALLOY PRODUCTS AND METHODS

RELATED APPLICATION

This application is a continuation-in-part of prior copending application Ser. No. 974,484 filed Dec. 29, 1978, abandoned.

BACKGROUND OF THE INVENTION

The present invention relates to aluminum alloys, and more particularly to a 2000 series alloy of the aluminum-copper-magnesium type characterized by high strength, very high fatigue resistance and very high fracture toughness.

A significant economic factor in operating aircraft today is the cost of fuel. As a consequence, aircraft designers and manufacturers are constantly striving to improve the overall fuel efficiency. One way to increase fuel efficiency, as well as overall airplane performance, is to reduce the structural weight of the airplane. Since aluminum alloys are used in a large number of the structural components of most aircraft, significant efforts have been expended to develop aluminum alloys that have higher strength to weight ratios than the alloys in current use, while maintaining the same or higher fracture toughness, fatigue resistance and corrosion resistance.

For example, one alloy currently used on the lower wing skins of some commercial jet aircraft is alloy 2024 in the T351 temper. Alloy 2024-T351 has a relatively high strength to weight ratio and exhibits good fracture toughness, good fatigue properties, and adequate corrosion resistance. Another currently available alloy sometimes used on commercial jet aircraft for similar applications is alloy 7075-T651. Alloy 7075-T651 is stronger than alloy 2024-T351; however alloy 7075-T651 is inferior to alloy 2024-T351 in fracture toughness and fatigue resistance. Thus, the higher strength to weight ratio of alloy 7075-T651 often cannot be used advantageously without sacrificing fracture toughness and/or fatigue performance of the component on which it is desired to use the alloy. Likewise, other currently available alloys in their various tempers, for example, alloys 7475-T651, -T7651, and -T7351 and 7050-T7651 and -T73651 and 2024-T851, although sometimes exhibiting good strength or fracture toughness properties and/or high resistance to stress corrosion cracking and exfoliation corrosion, do not offer the combination of improved strength, fracture toughness and fatigue properties over alloy 2024-T351. Thus, with currently available alloys in various tempers, it is usually impossible to achieve weight savings in aircraft structural components presently fabricated from alloy 2024-T351 while maintaining fracture toughness, fatigue resistance and corrosion resistance at or above the current levels.

It is therefore an object of the present invention to provide an aluminum alloy for use in structural components of aircraft that has a higher strength to weight ratio than the currently available alloy 2024-T351. It is a further object of the present invention to provide this aluminum alloy with improved fatigue and fracture toughness properties while maintaining stress corrosion resistance and exfoliation corrosion resistance at a level approximately equivalent to that of alloy 2024-T351.

SUMMARY OF THE INVENTION

The 2000 series alloy of the present invention fulfills the foregoing objects by providing a strength increase of from 5% to 8% over alloy 2024 in T3 tempers. Indeed, the alloy of the present invention is stronger than any other commercially available 2000 series aluminum alloy in the naturally aged condition. At the same time, the fracture toughness and fatigue resistance of the aluminum alloy of the present invention are higher than that achievable in aluminum alloys having strengths equal to or approaching that of the alloy of the present invention, such as alloy 2024 in the T3 or T8 tempers. Additionally, the corrosion resistance of the alloy of the present invention is approximately equivalent to that exhibited by alloy 2024 in the T3 type tempers.

The desired combination of properties of the 2000 series aluminum alloy of the present invention are achieved by precisely controlling the chemical composition ranges of the alloying elements and impurity elements, by maintaining a substantially unrecrystallized microstructure in the alloy for extruded products, and for plate products, by preaging and cold rolling to increase the strength of the alloy to high levels. The alloy of the present invention consists essentially of 3.8% to 4.4% copper, 1.2% to 1.8% magnesium, 0.3% to 0.9% manganese, the balance of the alloy being aluminum and trace elements. Of the trace and impurity elements present, the maximum allowable amount of zinc is 0.25%, of titanium is 0.15%, of chromium is 0.10%, of iron is 0.15%, and of silicon is 0.12%. For any other trace elements present in the alloy, the maximum allowable amount of any one such element is 0.05% and the total allowable amount of the other trace elements is 0.15%. For plate products, the maximum iron and silicon levels are preferably restricted to 0.12% and 0.10%, respectively. Once the alloy is cast, it is hot worked to provide a wrought product, such as extrusions or plate. The product is then solution treated, quenched, stretched and thereafter naturally aged at room temperature. In addition, the plate products are preaged and cold rolled 11±2% prior to stretching. The high strength of the invention alloy is achieved by the preaging and cold rolling procedure for plate products and by carefully controlling the extrusion parameters for extrusion products to avoid substantial recrystallization in the product. The fracture toughness and fatigue resistance of the alloy of the present invention are maintained at a high level by close control of chemical composition and also by the aforementioned processing controls.

BRIEF DESCRIPTION OF THE DRAWINGS

A better understanding of the present invention can be derived by reading the ensuing specification in conjunction with the accompanying drawings, wherein.

DETAILED DESCRIPTION OF THE INVENTION

Figure 1:
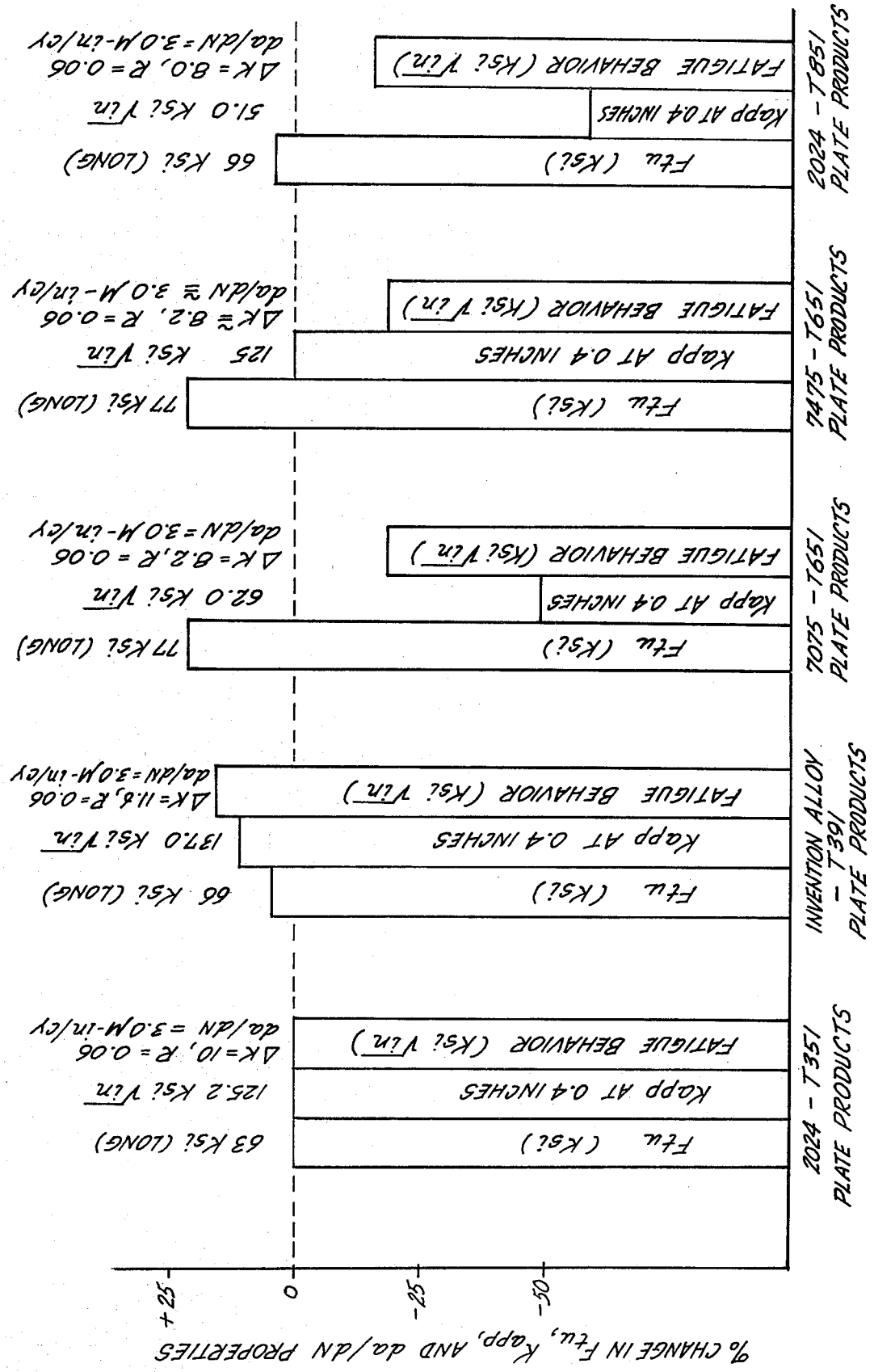
FIG. 1 is a plurality of bar graphs showing property comparisons for plate products produced from the invention alloy and other high strength 2000 and 7000 series aluminum alloys.

The high strength, high fatigue resistance, high fracture toughness and corrosion resistance properties of the alloy of the present invention are dependent upon a chemical composition that is closely controlled within specific limits as set forth below, upon a carefully controlled heat treatment, and for extrusion products, upon a microstructure that is substantially unrecrystallized. For plate products, specific preaging and cold rolling treatments are also employed to achieve the desired strength and fatigue properties. If the composition limits, fabrication, thermomechanical processing, and heat treatment procedures required to produce the invention alloy stray from the limits set forth below, the desired combination of strength increase, fracture toughness increase and fatigue improvement objectives will not be achieved.

The aluminum alloy of the present invention consists essentially of 3.8% to 4.4% copper, 1.2% to 1.8% magnesium, 0.3% to 0.9% manganese, the balance being aluminum and trace and impurity elements. For the trace and impurity elements zinc, titanium and chromium present in the invention alloy, the maximum allowable amount of zinc is 0.25%, of titanium is 0.15%, and of chromium is 0.10%. For the impurity elements iron and silicon, the maximum allowable amount of iron is 0.15% and of silicon is 0.12%. However, for plate products where cold rolling is utilized, it is desirable to reduce the maximum amount of silicon and iron in the invention alloy to 0.10% and 0.12%, respectively, in order to maintain the desired toughness in the plate product. For any other remaining trace elements, each has a maximum limit of 0.05%, with a maximum total for the remaining trace elements being 0.15%. The foregoing percentages are weight percentages based on the total alloy.

Conventional melting and casting procedures are employed to formulate the invention alloy. Care must be taken to maintain high purity in the aluminum and the alloying constituents so that the trace and impurity elements, especially iron and silicon, are at or below the requisite maximums. Ingots are produced from the alloy using conventional procedures such as continuous direct chill casting. Once the ingot is formed, it can be homogenized by conventional techniques, for example, by subjecting the ingot to elevated temperatures of about 920° F. for a period of time sufficient to homogenize the internal structure of the ingot and to provide an essentially uniform distribution of alloying elements. The ingot can then be subjected to hot working procedures to provide a desired product such as plate or extrusions. As will be described in more detail below, when hot working the alloy to produce extrusions, extreme care must be taken to prevent any substantial recrystallization. (The reduction of recrystallization, for example, less than 50 volume percent recrystallized, would also be desirable in plate products to enhance properties, although this is not necessary to achieve the property goals of the present invention.) By substantially unrecrystallized, it is meant that less than about 20 volume percent of the alloy microstructure in a given product is in a recrystallized form, excepting surface layers of extrusions which often show complete recrystallization. In any event, the surface layers of extrusion products are usually removed during fabrication into final part configurations. As will be described in more detail below, recrystallization can be minimized by maintaining the temperature of the alloy during hot working at levels that cause annealing out of internal strains produced by the working operation such that recrystallization will be minimized during the working operation itself, or during subsequent solution treatment.

After the alloy is hot worked into a product, the product is typically solution heat treated at a temperature on the order of 920° F. for a time sufficient for solution effects to approach equilibrium. Once the solution effects have approached equilibrium, the product is quenched using conventional procedures, normally by spraying the product with or immersing the product in room temperature water. After quenching, plate products produced from the invention alloy are preaged and cold rolled. Both plate and extruded products are stretcher stress relieved and naturally aged as the final processing steps.

Large intermetallic compounds formed during solidification, fabrication and heat treatment will lower the fracture toughness of the invention alloy. It is therefore most important to maintain the level of the elements which form intermetallic compounds at or below the allowable maximum set forth above. Intermetallic compounds may be formed from the major alloying elements copper, magnesium and manganese, as well as from impurity elements, such as iron and silicon. The amount of the major alloying element copper is constrained so that the maximum amount of this element will be taken into solid solution during the solution heat treatment procedure, while assuring that excess copper will not be present in sufficient quantities to cause the formation of any substantial volume of large, unwanted intermetallic particles containing this element. The amounts of the impurity elements iron and silicon are also restricted to the very low levels as previously indicated in order to prevent formation of substantial amounts of iron and silicon containing particles.

If the total of large intermetallic compounds formed by copper, magnesium, manganese, iron and silicon, such as $CuAl_2$, $CuMgAl_2$, $Al_{12}(Fe,Mn)_3Si$, $Al_7Cu_2Fe$ and $Mg_2Si$ in an alloy otherwise made in accordance with the present invention exceeds about 1.5 volume percent of the total alloy, the fracture toughness of the alloy will fall below the desired levels, and in fact may fall below the fracture toughness levels of similar prior art alloys of the 2024 type. The fracture toughness properties will be enhanced even further if the total volume fraction of such intermetallic compounds is within the range of from about 0.5 to about 1.0 volume percent of the total alloy. If the foregoing preferred range of intermetallic particles is maintained, the fracture toughness of the invention alloy will substantially exceed that of prior art alloys of similar strength.

For plate products produced from the invention alloy, the improved combination of strength, fracture toughness and fatigue properties are achieved not only by carefully controlling the chemical composition and by carefully controlled heat treatment, but especially by precisely controlled preaging and cold rolling procedures. When producing plate products, preaging the invention alloy at room temperature following quenching and prior to the cold rolling procedure will result in a maximum strength increase. It is preferred that the quenched alloy be age hardened to about ½ to ⅔ of the total yield strength gain expected through natural (room temperature) aging prior to cold rolling. For the alloy of the present invention, the required yield strength gain by preaging is achieved in a minimum of from about 4 to 6 hours. It is most preferred that the alloy be preaged from about 4 to about 10 hours prior to the cold rolling procedure. Preaging for a lesser time, for example on the order of about 2 hours at room temperature, will reduce the ultimate strength of the invention alloy by 2 ksi or more. Preaging for longer than 10 hours will result in little additional strength gain and may lead to breakage problems during the stretcher stress relief operation.

Strength levels above those obtainable with, for example, commercially available 2024-T351 plate (also referred to as the baseline alloy) are obtained by cold rolling the plate product of the alloy of the present invention following solution treatment, quenching and preaging. The cold roll treatment of the present invention alloy increases its ultimate strength nearly 8 ksi over that of a similar non-cold rolled alloy, thus increasing the ultimate strength of the invention alloy about 5% over that of alloy 2024-T351, for example. This increase in ultimate strength is obtained even though the invention alloy has lesser nominal amounts of alloying constituents than the baseline alloy 2024-T351. It must be noted that the strength increase brought about by the cold rolling procedure carries a commensurate decline in the fracture toughness properties of the alloy. Thus, the increase in strength brought about by the cold rolling step would be compromised and perhaps not advantageous, were it not for the substantial initial enhancement in fracture toughness brought about by careful composition control in the invention alloy. Thus, even though the exceptional fracture toughness properties of the invention alloy are somewhat reduced in tradeoff for an increase in ultimate strength via the cold rolling step of the present invention, the final mix in properties of the invention alloy is balanced such that both increased strength and increased toughness over that of the baseline alloy 2024-T351 are achieved.

The cold rolling procedure of the present invention is preferably accomplished in as few passes possible since it has been found that numerous light passes tend to concentrate the results of the cold work in the surface layers of the plate, causing strength and stress gradients to develop through the thickness of the product. Preferably, only one or two passes of the plate product through the rolls are employed to achieve the desired reduction in thickness. It is preferred that the invention alloy be reduced in thickness during the cold rolling procedure from about 9% to about 13% of its original thickness prior to being cold rolled. Cold reductions less than about 9% will result in lower strength levels than desired for plate applications in aircraft structures and reductions greater than about 13% will cause deteriorations in the fracture toughness properties of the alloy. If the cold reduction of the invention alloy is greater than 13%, the product will be increasingly susceptible to breakage during the final stretching operation, sometimes rendering the resulting product unusable. However, when the cold reduction is limited to the range of from 9% to 13%, breakage is infrequent and can normally be attributed to obvious undesirable physical flaws in the product.

It has also been discovered that the cold working procedure, in conjunction with the microstructure brought about by the composition control and the preage techniques, will enhance the fatigue properties of the invention alloy. It is believed that the cold working procedure produces arrays of dislocations in the alloy microstructure that are effective in slowing fatigue crack initiation and growth. A microstructure free of most large intermetallic compounds, is effective in slowing fatigue crack growth rate for faster growing fatigue cracks.

As mentioned above, the preaging and cold rolling procedures are not employed for extruded products. Rather, the extrusion procedure itself is controlled to minimize recrystallization in the final product and to thus maintain the strength and toughness of the product at the desired improved levels. Recrystallization in the alloy is minimized by extruding somewhat hotter and slower than prior art alloys are normally extruded to allow an improved partial anneal to take place during the extrusion process, and thereby remove any regions of very high strain that otherwise would lead to recrystallization during the final solution heat treatment. It has been found that the desired properties can be achieved if the alloy of the present invention is extruded at temperatures at or above about 770° F. while holding the extrusion speed such that the degree of recrystallization in the final wrought product is minimized. Exact extrusion speeds and temperatures are of course dependent upon such factors as starting billet size, extrusion size and shape, number of die openings, and method of extrusion (direct or indirect). Unlike plate products, it is necessary to achieve a substantially unrecrystallized structure in the extruded product in order to obtain the desired mix of properties. The unrecrystallized structure thus produced is very beneficial to strength. A 10 ksi or greater differential has been noted between unrecrystallized and recrystallized structures of extrusions of the invention alloy. Likewise, the unrecrystallized structure is usually superior to its recrystallized counterpart in fatigue resistance, as it is more difficult to nucleate fatigue cracks in the finer unrecrystallized structure of the invention alloy.

Both plate and extruded products are stretched as a final working procedure in order to flatten and strengthen the product and to remove residual quenching and/or rolling stresses from the product. For plate, which is in a cold worked condition at the time of stretching, it has been determined that a 1% minimum stretch is sufficient in contrast to the 1–1½% minimum normally required for plate products made from conventional, commercially available alloys. It should be noted that the stress patterns in the cold worked invention alloy are reversed from those of normal solution treated and quenched material; i.e., the surface layers of the invention alloy are in tension and the center is in compression. Stretching a product of the invention alloy beyond 2% to 3% causes increased incidence of breakage during the stretching process, an unwanted result that is avoided by preferably limiting the stretching to the 1% minimum requirement. Extrusions are stretched 1% to 3%, as is normally required for all commercial alloys. Unlike plate products of the invention alloy, extrusions are in a relatively soft condition during the stretching operation and are not susceptible to an increased incidence of breakage.

EXAMPLES

To illustrate the benefits of the invention alloy, the importance of composition control, microstructure control, and cold working practices, the following Examples are presented.

EXAMPLE I

More than 50 ingots of the alloy of the present invention were formulated in accordance with conventional procedures. These ingots had a nominal composition of 4.1% copper, 1.5% magnesium, 0.5% manganese, 0.06% iron, 0.05% silicon, <0.01% chromium, 0.02% titanium, 0.03% zinc, and a total of about 0.03% of other trace elements, the balance of the alloy being aluminum. The ingots were rectangular in shape and had nominal thicknesses of 16 inches. The ingots were scalped, homogenized at about 920° F., and hot rolled to plate thicknesses varying from 0.5 to about 2.0 inches. These plates were then solution heat treated at about 920° F. for 1 to 2 hours, depending on thickness, and spray quenched with room temperature water. The plates were then naturally preaged for times varying from 4 to 10 hours at room temperature, cold rolled to a thickness reduction of 11±2%, stretched by amounts varying from 1% to 3% in the rolling direction to minimize residual quenching and rolling stresses, and naturally aged for 4 days at room temperature. Ultimate tensile strength, fracture toughness and fatigue crack growth rate tests were then run on specimens taken from the plate product. The data from these tests were analyzed to provide minimum strength and mean fracture toughness and fatigue crack growth rate values for each of the tests.

Similar data from conventional, commercially available 2024-T351 alloy, 2024-T851 alloy, 7075-T651 alloy and 7475-T651 alloy plate were also analyzed for comparison. The 2024 alloy had a nominal composition of 4.35% copper, 1.5% magnesium, 0.6% manganese, 0.26% iron, 0.15% silicon, the balance of the alloy being aluminum and small amounts of other extraneous elements. The 7075 alloy had a nominal composition of 5.6% zinc, 2.5% magnesium, 1.6% copper, 0.2% chromium, 0.05% manganese, 0.2% iron and 0.15% silicon, the balance of the alloy being aluminum and small amounts of other extraneous elements. The 7475 alloy had a nominal composition of 5.7% zinc, 2.25% magnesium, 1.55% copper, 0.20% chromium, 0.08% iron, 0.06% silicon, 0.02% titanium, the balance of the alloy being aluminum and small amounts of other extraneous elements.

Ultimate tensile strength tests were run in a conventional manner.

The fracture toughness tests were also run in a conventional manner at room temperature using center cracked panels, with the data being represented in terms of the apparent critical stress intensity factor ($K_{app}$) at panel fracture. The stress intensity factor ($K_{app}$) is related to the stress required to fracture a flat panel containing a crack oriented normal to the stressing direction and is determined from the following formula:

$$K_{app} = \sigma_g \sqrt{\pi a_o}\ \alpha$$

wherein $\sigma_g$ is the gross stress required to fracture the panel;

$a_o$ is one-half the initial crack length for a center cracked panel, and $\alpha$ is a finite width correction factor (for the panels tested, $\alpha$ was slightly greater than 1).

For the present tests, 16-inch wide to 48- inch wide panels containing center cracks approximately one-third the panel width were used to obtain the $K_{app}$ values.

The data for the fatigue crack growth rate comparisons were taken from data developed from precracked, single edge notched panels. The panels were cyclically stressed in laboratory air in a direction normal to the orientation of the fatigue crack and parallel to the rolling direction. The minimum to maximum stress ratio (R) for these tests were 0.06. Fatigue crack growth rates (da/dN) were determined as a function of the cyclic stress intensity parameter ($\Delta K$) applied to the precracked specimens. The parameter $\Delta K$ (ksi $\sqrt{in}$) is a function of the cyclic fatigue stress ($\Delta\sigma$)applied to the panel, the stress ratio (R), the crack length and the panel dimensions. Fatigue comparisons were made by noting the cyclic stress intensity ($\Delta K$) required to propagate this fatigue crack at a rate of 3.0 microinches/cycle for each of the alloys.

The results of the strength, fracture toughness and fatigue crack growth rate tests are set forth in the bar graphs of FIG. 1 as percentage changes from the baseline alloy 2024-T351, which was chosen for comparison as its composition is similar to that of the invention alloy and as it is currently used for many aircraft applications, including lower wing surfaces. The values for the minimum ultimate tensile strength ($F_{tu}$) (99% of the test specimens meet or exceed the value shown with a 95% confidence level) and the average $K_{app}$ are set forth at the top of the appropriate bar in FIG. 1. Fatigue crack growth rate behavior is expressed as a percentage difference between the average cyclic stress intensity ($\Delta K$) required for a crack growth rate of 3.0 microinches/cycle for a given alloy and the $\Delta K$ required for a crack growth rate of 3.0 microinches/cycle in 2024-T351. As can be seen from FIG. 1, the $\Delta K$ level required to provide a crack growth rate of 3.0 microinches/cycle for the 2024-T351 alloy was about 10 ksi $\sqrt{in.}$; for the alloy of the present invention was 11.6 ksi $\sqrt{in.}$; for the 7075-T651 alloy was 8.2 ksi $\sqrt{in.}$; for the 7475-T651 alloy was 8.2 ksi $\sqrt{in.}$; and for the 2024-T851 alloy was 8.0 ksi $\sqrt{in.}$ The bar graphs in FIG. 1 illustrate that the alloy of the present invention has strength, fracture toughness and fatigue properties that are 5% to 16% better than the 2024-T351 baseline alloy. As can be seen, the 7075-T651 alloy, the 7475-T651 alloy, and the 2024-T851 alloy all have strength properties that are equal or superior to that of the invention alloy; however, the fatigue and fracture toughness properties of these alloys are not only below that of the alloy of the present invention but are also significantly below that of the baseline alloy 2024-T351. Thus, it is observed that by staying within the compositional limits of the alloy of the present invention, by careful preaging and cold rolling of the plate product, and by naturally aging the alloy of the present invention to a stable condition can all three properties, strength, fracture toughness and fatigue, be improved over that of the baseline alloy 2024-T351. Although not specifically noted in the above comparisons, it is emphasized that comparisons for extruded products show similar relative improvements for the invention alloy over the same prior art alloys.

EXAMPLE II

Figure 2:
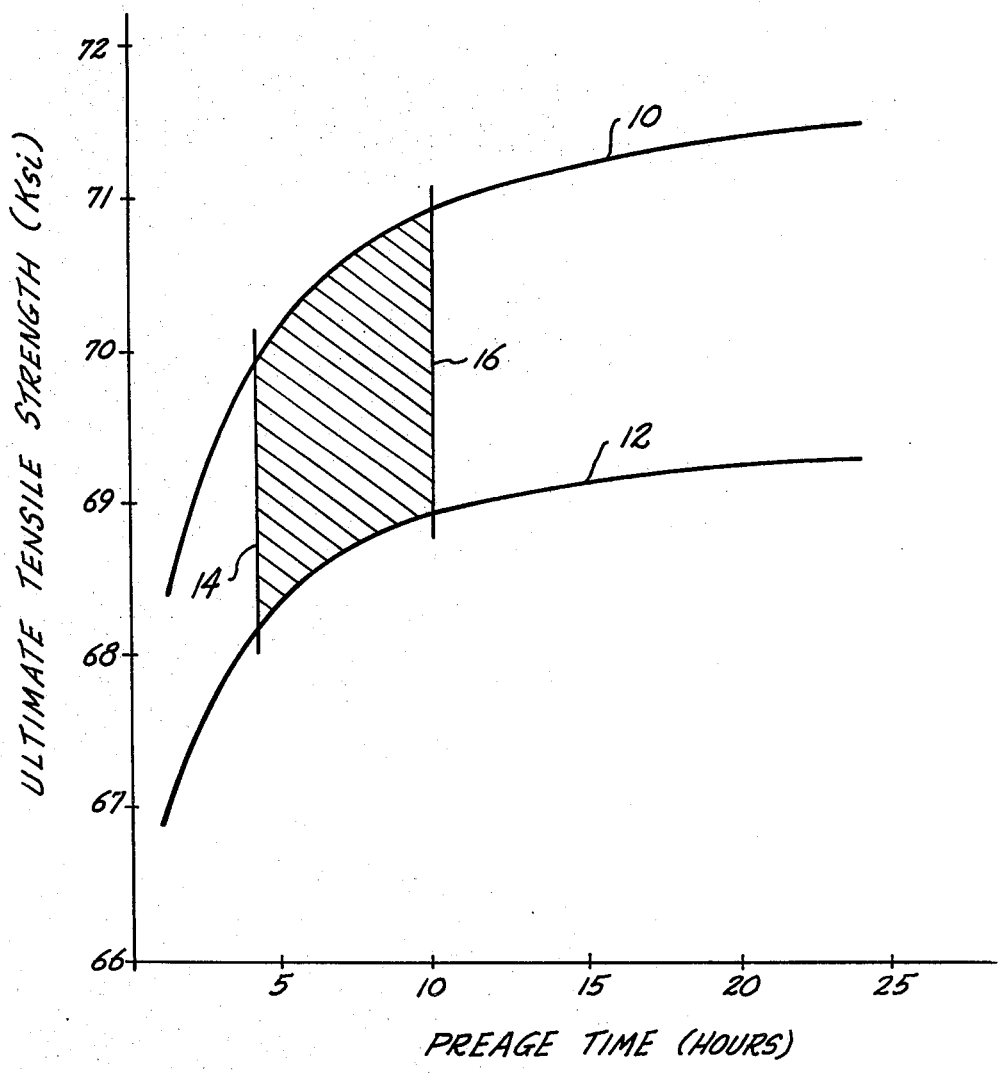
FIG. 2 is a graph of ultimate tensile strength versus preage time prior to cold reduction by rolling for plate products produced from the invention alloy.

Procedures similar to those of Example I were employed to produce plate products from typical ingots of the alloy of the present invention. The alloys had nominal composition similar to those of the ingots produced from the alloy of the present invention set forth in Example I. After quenching, the plate products were naturally aged at room temperature for various times up to 24 hours, cold rolled 10%, stretched a minimum of 1%, and then naturally aged a minimum of 4 days. Specimens taken from the products were then tested for ultimate tensile strength using conventional procedures. The resulting tensile strengths were plotted versus preaging time between quenching and cold rolling and found to fall within the bounds of curves 10 and 12 of FIG. 2. Curve 10 represents the upper limit of ultimate strength for a given preage time while curve 12 represents the lower limit of ultimate strength for the same given preage time. It will be noted that the typical ultimate strength of the alloy of the present invention increases 2 to 3 ksi if a time delay (preaging time) of 4 hours or more is allowed between quenching and cold rolling. The graphs reveal that about two-thirds of the total strength increase is achieved by preaging at room temperature for only 4 hours. It is recommended that at least a 4 hour preaging time be allowed after quenching before rolling is accomplished. If the preaging time is too long, an increase in breakage of the plate product is encountered during the final stretching operation. A practical preaging upper time limit is about 10 hours, although longer preaging times are acceptable for a given alloy if the stretching operation can be accomplished without excessive breakage problems. The preferred limits of 4 to 10 hours for preaging are indicated by the vertical lines 14 and 16 in FIG. 2.

EXAMPLE III

The procedures of Example I were employed to produce plate products from typical ingots of the alloy of the present invention having the nominal composition set forth in Example I. The plate products were subjected to various degrees of reduction by cold rolling. The plates were preaged from 4 to 10 hours prior to cold rolling. Conventional procedures were employed to determine the ultimate tensile strength of specimens taken in the longitudinal grain direction from the various plates. The data thus derived indicates that a steady rise in ultimate strength occurs as the amount of cold reduction is increased. The rate of rise is approximately 0.73 ksi in ultimate strength for each percent of cold reduction over the range of 10% to 15% reduction. The mean strength increase for the various specimens was calculated and plotted versus percent reduction by cold rolling as graph 18 in FIG. 3. The data also allowed confidence limits to be established for minimum and maximum strength. The calculated minimum and maximum strengths are also plotted versus percent reduction by cold rolling in FIG. 3 as graphs 20 and 22, respectively. The limits shown are for 99% of the data points being at or within the values shown with a confidence of 95%, hereafter the "99%/95% confidence level." It should be noted that confidence limits are a function of the number of specimens tested as well as means and standard deviation values. For the 57 specimens tested, the 99%/95% confidence level is based on 2.82 standard deviations.

Figure 3:
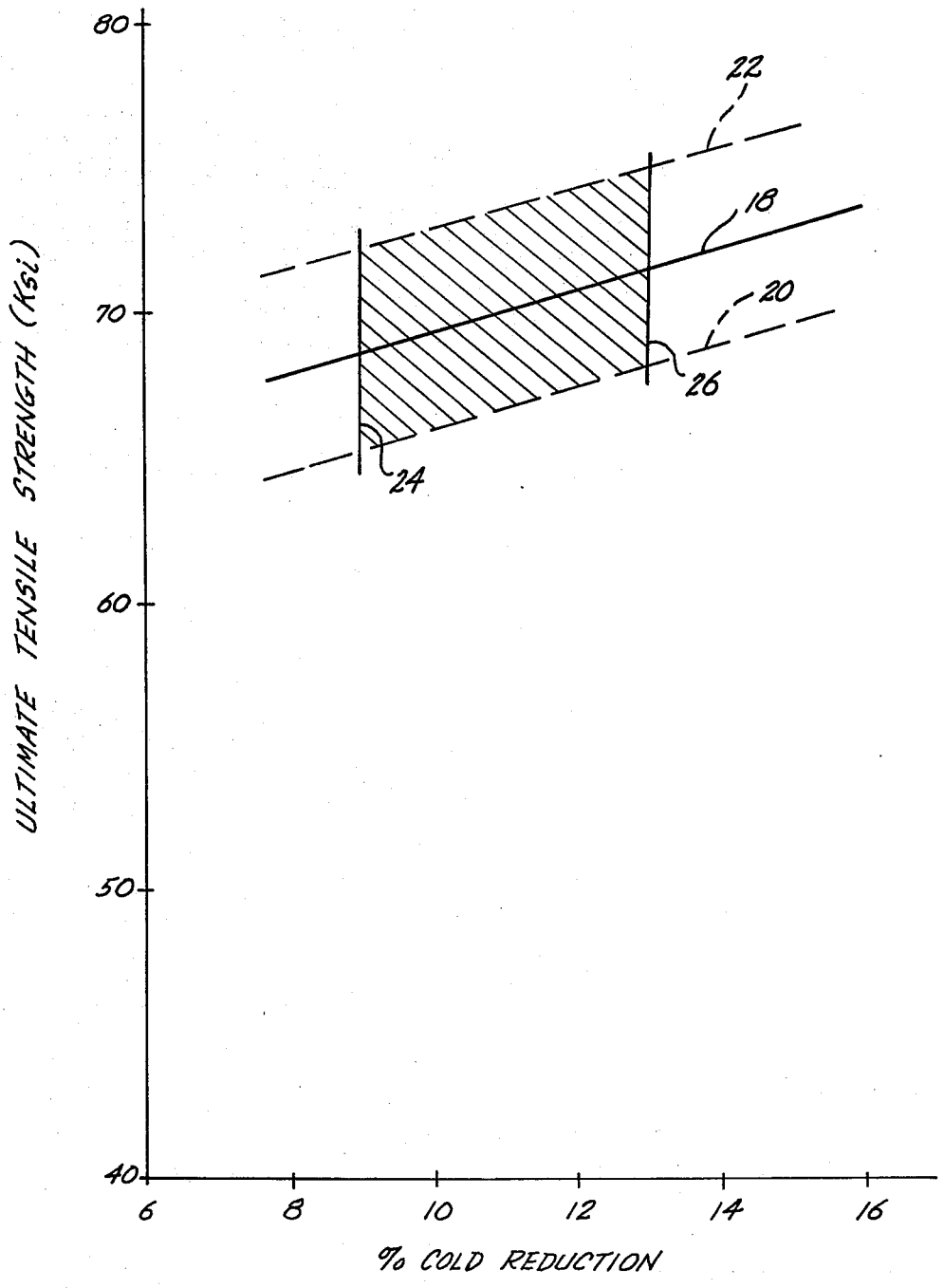
FIG. 3 is a graph of ultimate tensile strength versus percent of cold reduction by rolling for plate products produced from the invention alloy.

It will be noted from FIG. 3 that the mean strength of the new material at 11% cold roll reduction is approximately 70 ksi and the minimum value is slightly greater than 66 ksi at 11% cold roll reduction. Although the lower limit of material with less than 11% cold roll reduction is lower than 66 ksi, it is compensated for by the higher limit for material with greater than 11% cold roll reduction; consequently, it has been established that a minimum 99%/95% confidence level of 66 ksi can be adhered to for this product if cold rolling is maintained in the range of 11±2%. Further, an inadequate strength increase is obtained if the cold roll reduction falls below 9%. As will be further exemplified, cold roll reduction in excess of 13% results in increased breakage during the final processing step of stretching. Thus, it is necessary to stay within the reduction limits of 11±2% in order to achieve the desired properties of the invention alloy. The 9% lower limit is indicated by vertical line 24 in FIG. 3 and the 13% upper limit by vertical line 26.

EXAMPLE IV

While increasing amounts of cold reduction after preaging increase the strength of the invention alloy, as illustrated in Example II, a decrease in fracture toughness also accompanies increasing amounts of cold reduction. Thus, in order to maintain a high level of fracture toughness while increasing strength of the alloy, the chemical composition limits specified earlier must be adhered to and the degree of cold rolling must be carefully controlled.

Figure 4:
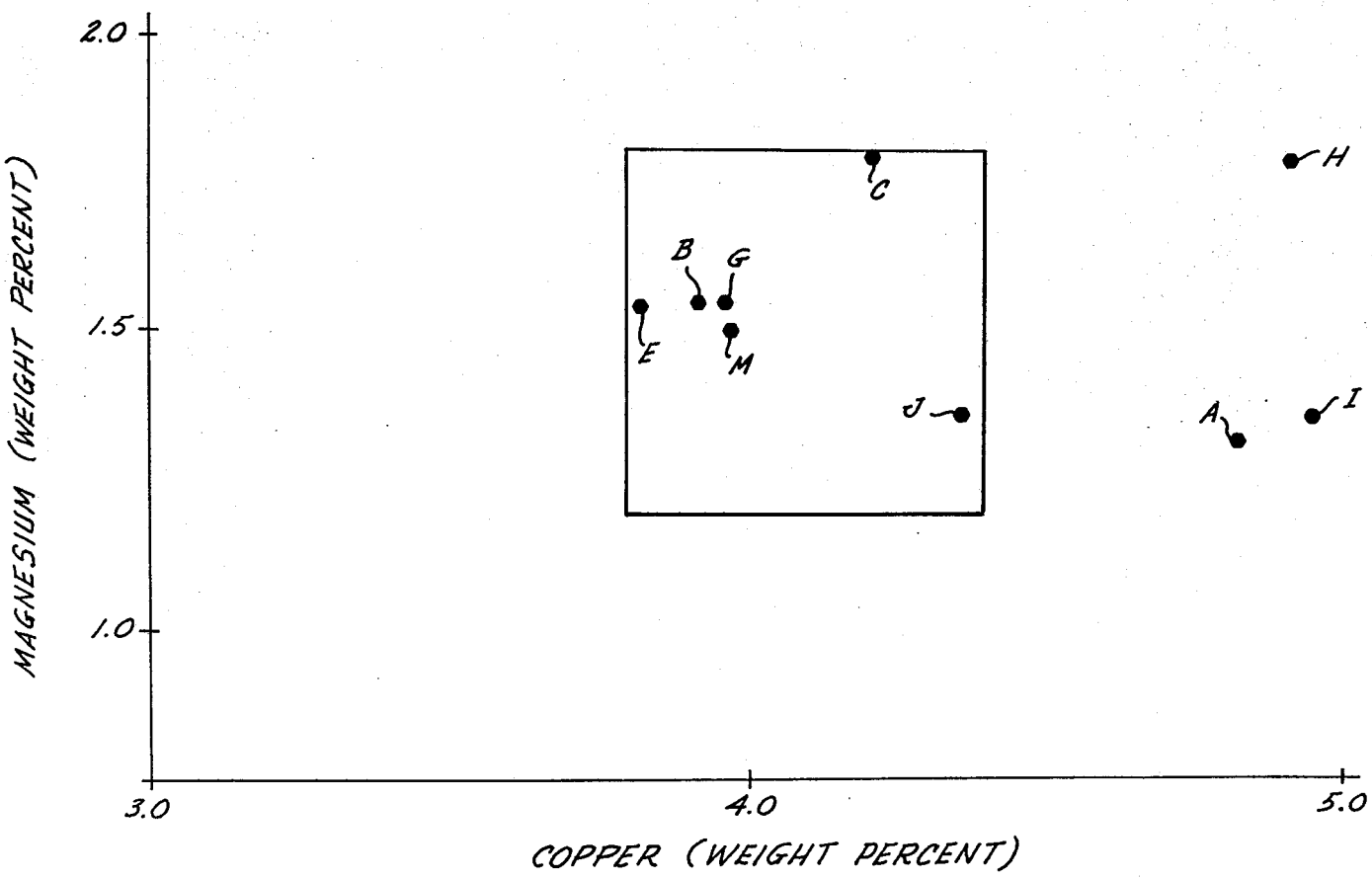
FIG. 4 is a graph of chemical composition limits of copper and magnesium in the invention alloy and 2000 series experimental alloys.

Conventional precracked Charpy impact specimens were used to measure the toughness of plate produced from several experimental heats of the invention alloy and plate produced from selected 2024 alloys. In these tests, the impact energy (W/A) in in-lbs/square inch required to fracture a fatigue precracked Charpy impact specimen was used as the measure of toughness. The alloys were fabricated in the manner described in Example I, except that the degree of cold reduction was varied from 0% to 15%. The copper and magnesium contents for the invention alloy and other experimental alloys used for comparison are shown in FIG. 4. The copper and magnesium limits for the invention alloy are bounded by the box appearing in FIG. 4. Alloys C, E, B, G, M, and J fall within the compositional range required for the alloy of the present invention. Alloys H, I, and A are outside the compositional limits of the alloy of the present invention and are similar to alloy 2024. All of the alloys plotted in FIG. 4 have a manganese content in the range of 0.47% to 0.57%, an iron content of 0.08% to 0.09% (alloy A has an iron content of 0.30%), and a silicon content in the range of 0.04% to 0.08%. The copper and magnesium contents vary as indicated in FIG. 4. The remaining trace elements are each present in an amount less than 0.05% while the total of the remaining trace element is less than 0.15% of the weight of the alloy.

Figure 5:
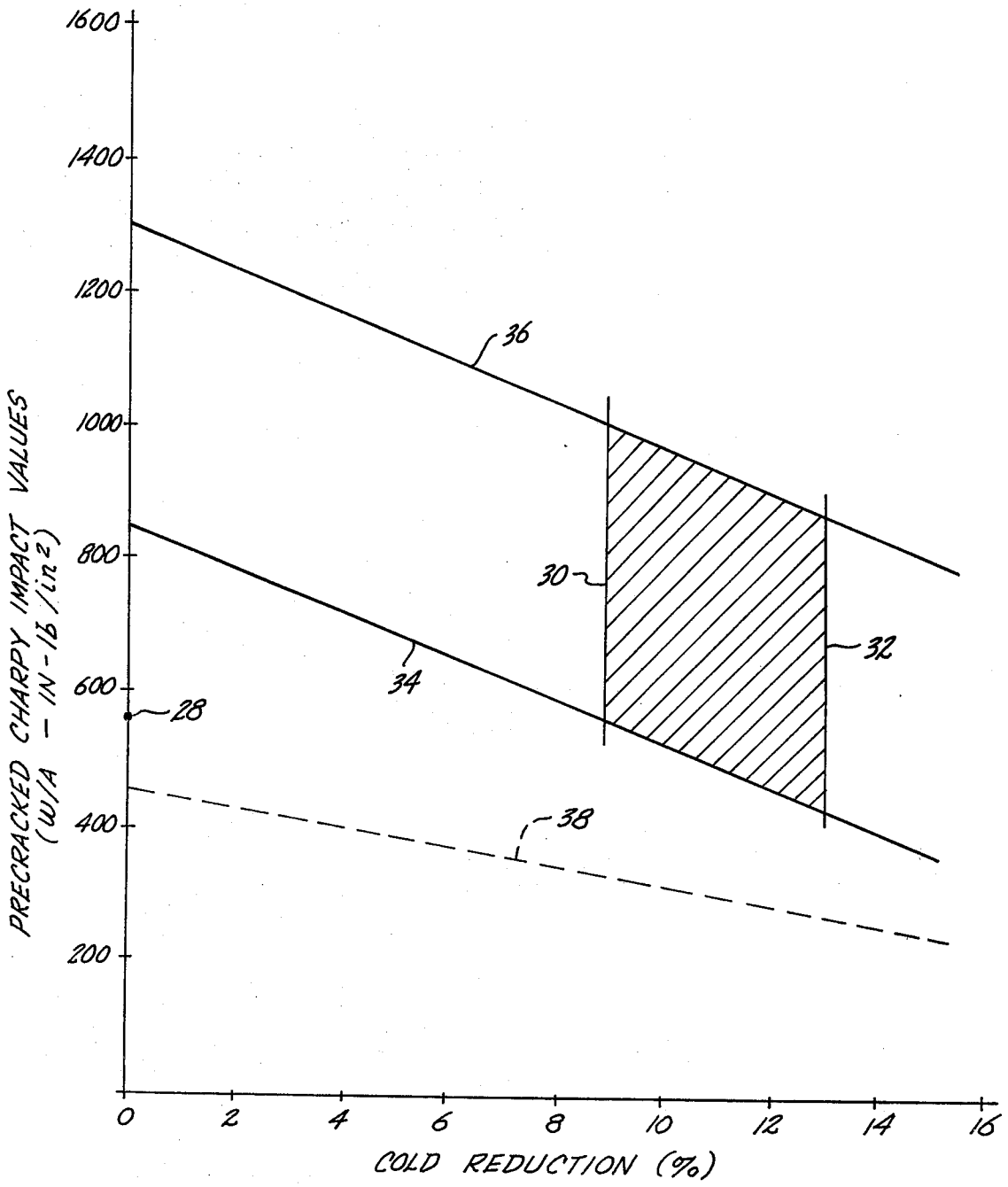
FIG. 5 is a graph of the fracture toughness parameter, W/A, versus percent cold reduction by rolling for the invention alloy and for 2000 series experimental alloys.

The toughness values (W/A) for these alloys are plotted versus percent cold reduction by rolling in FIG. 5. The range of cold reduction (11±2%) specified for the alloy of the present invention is indicated by vertical lines 30 and 32. The toughness levels for all alloys decrease with increasing amount of cold reduction, but the invention alloy B, C, E, G, J, and M have higher average toughness properties and thus fall within the data band between curves 34 and 36 in FIG. 5. The toughness values for 2024 type alloys, A, H and I outside the compositional range of the invention alloy all fall within the area between curves 38 and 34, indicating that a copper content higher than that of the invention alloys detracts from toughness. For purposes of comparison, the mean toughness value for commercial alloy 2024-T351 without cold reduction is shown as point 28 on FIG. 5. It will be noted that the mean toughness value of alloy 2024-T351 without cold work is below that of the invention alloy. Further, as alloy 2024-T351 is cold rolled, its toughness decreases even further. Since the invention alloy has an extremely high initial toughness without cold work, the invention alloy exhibits average toughness levels above the mean toughness level of alloy 2024-T351 even after the invention alloy has been subjected to the required 11±2% cold reduction.

EXAMPLE V

Additional fracture toughness tests were conducted on center cracked test panels produced from the alloy of the present invention and alloy 2024-T351. The alloys were produced in accordance with the procedure set forth in Example I, except that the cold reduction was 11% for one set of panels produced from the invention alloy while the cold reduction on another set of panels was 14%. In addition, one set of panels produced from the invention alloy was given the specified 11% nominal cold reduction and was further given a stabilization age treatment of 24 hours at 190° F. to simulate several years of room temperature exposure. The test panels had varying thicknesses and were machined from approximately 1.0 inch thick plate produced from the alloys. The nominal composition of the alloy of the present invention, and of alloy 2024 were the same as those shown in Example I.

Figure 6:
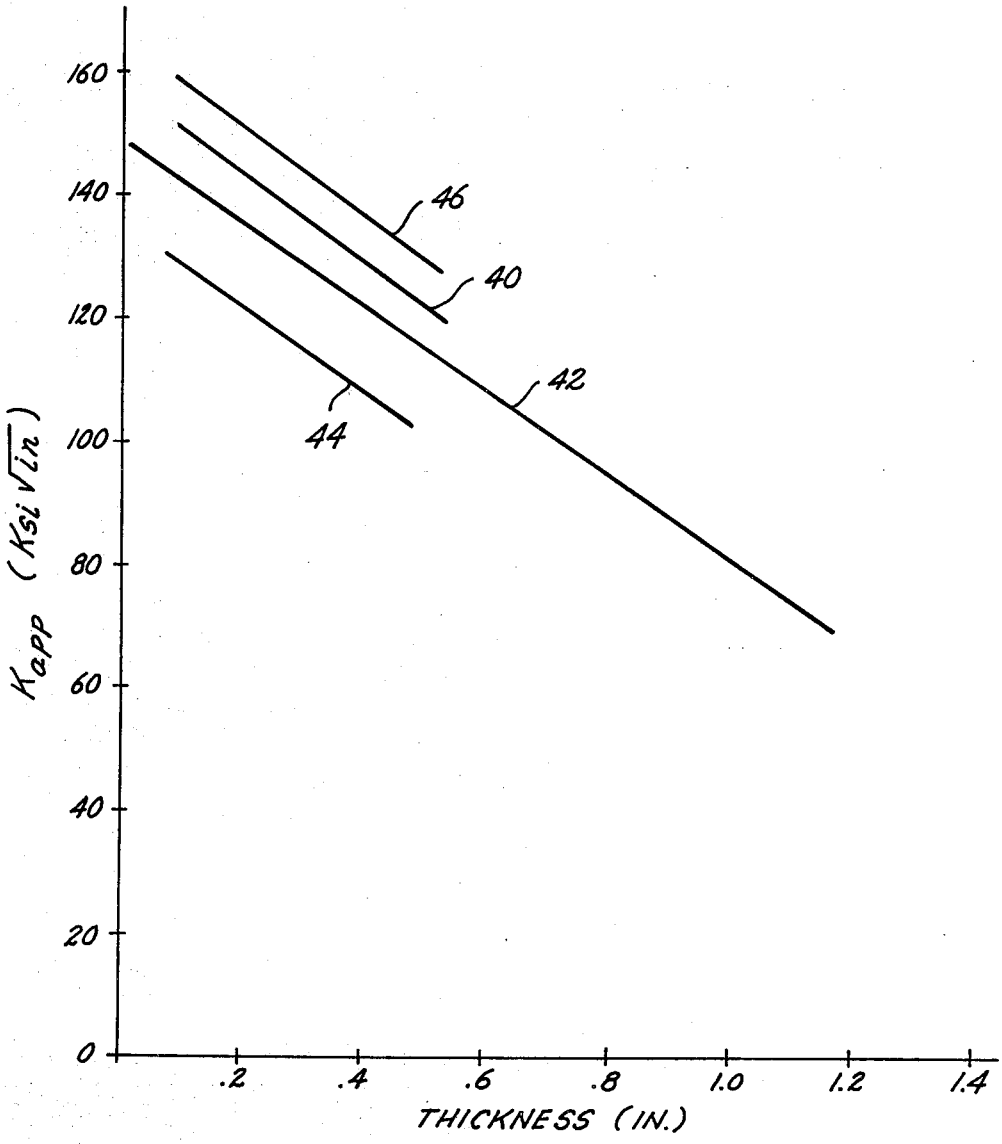
FIG. 6 is a graph of the fracture toughness parameter, $K_{app}$, versus thickness for alloy 2024-T351 and for the invention alloy.

The fracture toughness data recorded as the apparent stress intensity factor ($K_{app}$) from several tests at room temperature were averaged and are plotted versus panel thickness in FIG. 6. The fracture toughness for the product produced from the alloy of the present invention with 11% nominal cold reduction is shown by graph 40 in FIG. 6, the fracture toughness for the 2024-T351 alloy by graph 42, the fracture toughness for the alloy having the composition of the invention alloy but with 14% nominal cold reduction by graph 44 and the fracture toughness for the invention alloy given the stabilization age treatment by graph 46. As will be observed, the alloy of the present invention with 11% cold roll exhibits better fracture toughness than alloy 2024-T351. After 14% cold reduction, the invention alloy is inferior to the alloy 2024-T351, but still useful for many applications. In the 14% cold rolled condition, the strength advantage of the alloy is increased 8% over 2024-T351. The invention alloy given the stabilizing age treatment has the highest toughness and thus it can be concluded that the invention alloy will increase in toughness with time following manufacture. During this period of increasing fracture toughness, there is some reduction in tensile yield strength but none in tensile ultimate strength, which is the key property of interest for design purposes. However, this reduction in tensile yield strength is only about 3 ksi, an amount of little consequence since the tensile yield strength is still about 9 ksi above that for conventional 2024-T351 alloys.

EXAMPLE VI

The fatigue crack growth rate (da/dN) properties of the alloy of the present invention are improved over other commercial alloys having similar characteristics, namely alloys 2024-T351, 7075-T651, and 2024-T851. Seven production lots of plate material produced from the alloy of the present invention were prepared in accordance with the general procedures set forth in Example I. In addition, eight production lots of alloy 2024-T351 plate, nine production lots of alloy 7075-T651 plate, and four production lots of alloy 2024-T851 plate were analyzed using the general procedures outlined in Example I. Fatigue crack growth rate tests were conducted on precracked, single edge notched panels produced from the production lots of each of the alloys. For the alloy of the present invention, eleven da/dN tests were run; for alloy 2024-T351, eight da/dN tests were run; for alloy 7075-T651, nine da/dN tests were run; and for alloy 2024-T851, five da/dN tests were performed. The da/dN values for the various alloys were then averaged and plotted in FIG. 7 as the mean values of the crack growth rates (da/dN) in microinches per cycle versus the cyclic stress intensity parameter (ΔK) for each of the alloys. Curve 50 represents the crack growth rate for 2024-T851 alloy, curve 52 for 7075-T651 alloy, curve 54 for 2024-T351 alloy, and curve 56 for the alloy of the present invention. As is readily observed from the graphs of FIG. 7, the alloy of the present invention has superior fatigue crack growth rate properties at each stress intensity level examined when compared with alloys 2024-T351, 7075-T651, and 2024-T851.

Figure 7:
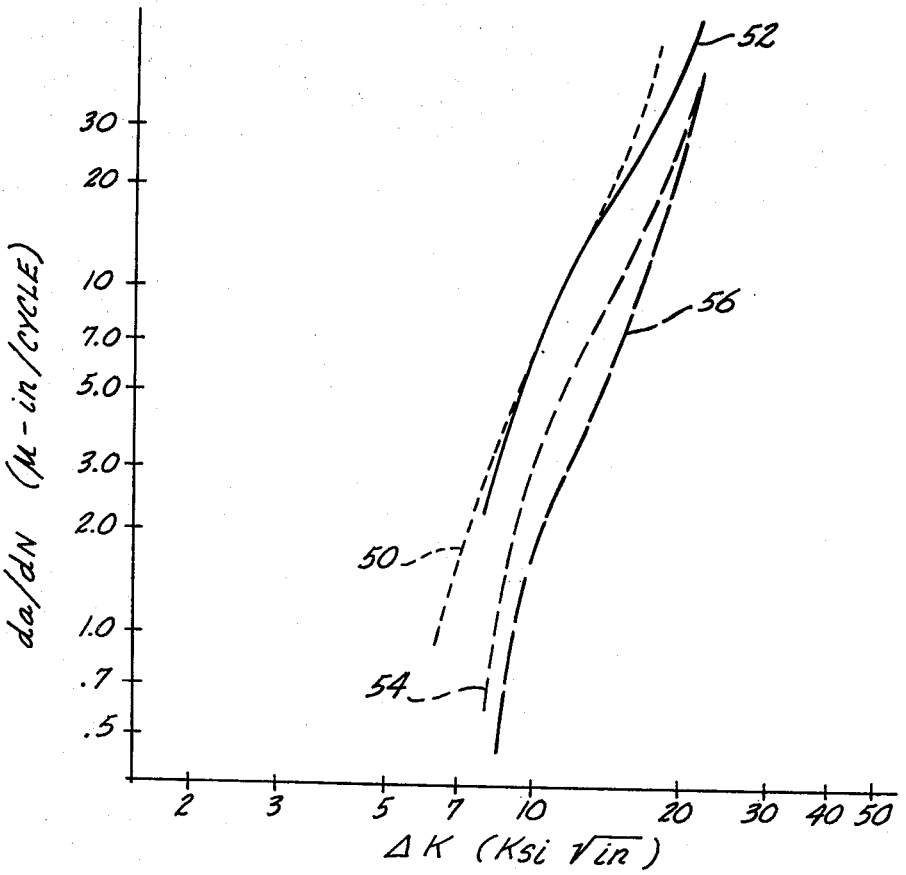
FIG. 7 is a graph of fatigue crack growth rate, da/dN, versus the stress intensity factor, ΔK, for the invention alloy and for alloys 2024-T351, 2024-T851 and 7075-T651.
Figure 8:
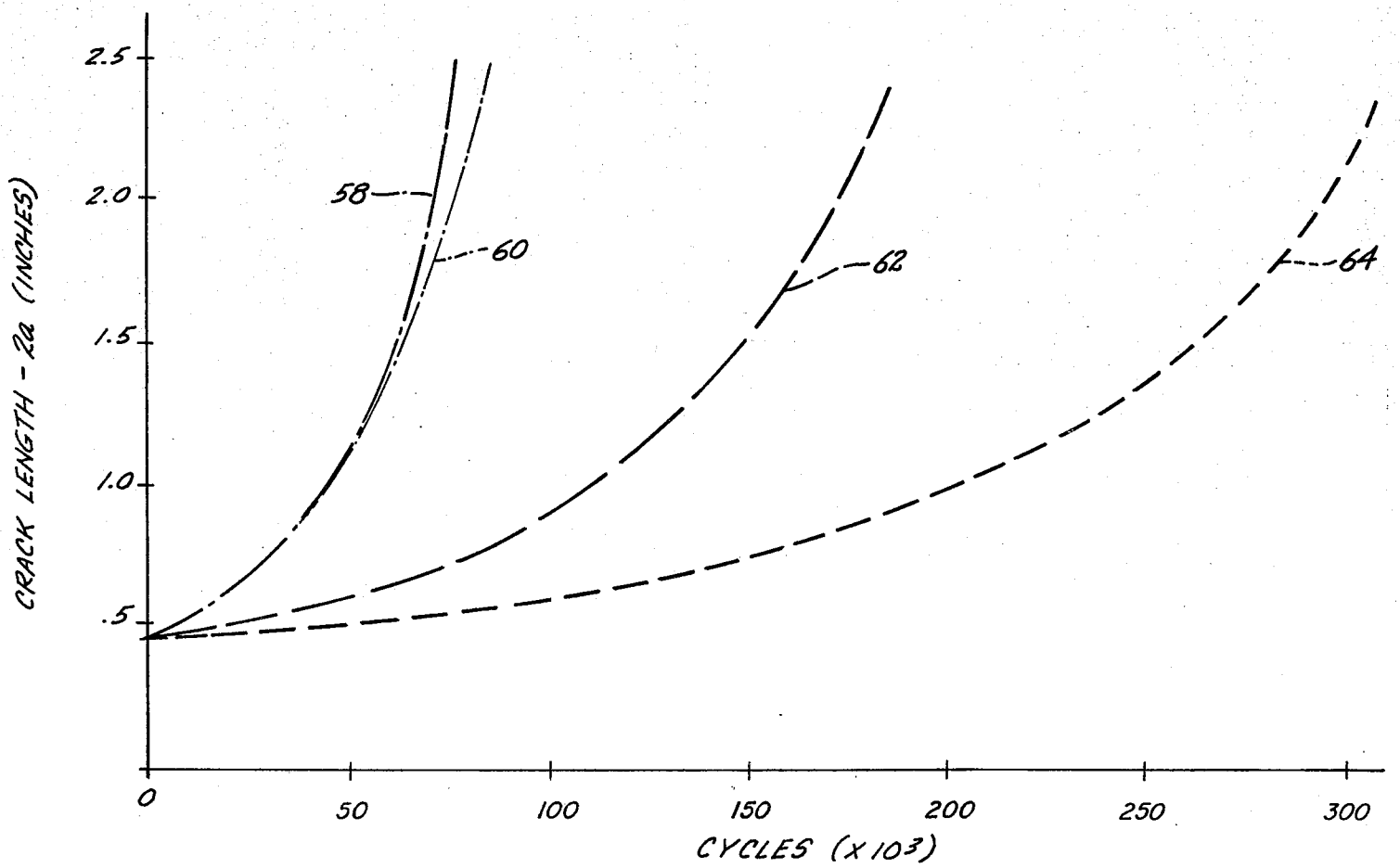
FIG. 8 is a graph of fatigue crack length versus stress cycles for the invention alloy and for alloys 2024-T351, 2024-T851, and 7075-T651.

The data from FIG. 7 were utilized to plot the graphs of FIG. 8 wherein crack length is plotted versus the number of stress cycles, wherein the maximum stress applied was selected to be 10,000 psi and wherein the minimum to maximum stress ratio (R) was equal to 0.06. The initial crack length in the panels was selected to be 0.45 inches. Curve 58 is the graph of the data for the 2024-T851 alloy, curve 60 for the 7075-T651 alloy, curve 62 for the 2024-T351 alloy, and curve 64 for the alloy of the present invention. Again, the graphs of FIG. 8 clearly illustrate that the alloy of the present invention outperforms alloys 2024-T851, 7075-T651, and 2024-T351 in crack growth rate properties.

As can be readily observed by reference to the foregoing Examples, the alloy of the present invention has a superior combination of strength, fracture toughness, and fatigue resistance when compared to the prior art alloys typified by 2024-T351, 7075-T651, 7475-T651 and 2024-T851. Other tests conducted on the alloy of the present invention and on comparable 2024-T351 products also indicate that the stress corrosion resistance and exfoliation corrosion resistance are approximately equivalent, and thus the alloy can be employed for the same applications, such as wing panels and the like.

Accordingly, one of ordinary skill, after reading the foregoing specification, will be able to effect various changes, substitutions of equivalents, and other alterations to the compositions and procedures set forth above without varying from the general concepts disclosed. For example, artificial aging the alloy of the present invention to the T8 type tempers from the presently defined T3 type tempers will yield superior plate and extrusion products than are available with current alloys in T6 and T8 type tempers. It is therefore intended that a grant of Letters Patent hereon be limited only by the definition contained in the appended claims and equivalents thereof.

The embodiments of the invention in which an exclusive property or privilege is claimed are defined as follows:

1. A plate product produced from an Al-Cu-Mg alloy having high strength and toughness and improved fatigue properties consisting essentially of

| weight percent | element |
|---|---|
| 3.8 to 4.4 | Cu |
| 1.2 to 1.8 | Mg |
| 0.3 to 0.9 | Mn |
| 0.12 maximum | Si |
| 0.15 maximum | Fe |
| 0.25 maximum | Zn |
| 0.15 maximum | Ti |
| 0.10 maximum | Cr |
| 0.05 maximum | each trace element |
| 0.15 maximum | total of trace elements |
| balance | Al, |

said alloy being hot worked to yield a plate product, said product being subjected to a solution heat treatment such that the maximum amount of Cu is taken into solid solution during solution heat treatment, said product being quenched, said product being preaged and then reduced in thickness by cold rolling, and said product being stretched to relieve residual stresses in said product.

2. The product of claim 1 wherein said alloy is preaged for at least about four hours prior to cold rolling said product.

3. The product of claim 2 wherein said alloy is reduced in thickness from 9% to 13% by cold rolling.

4. The product of claim 2 wherein said alloy is preaged from about four to about ten hours.

5. The product of claim 1 wherein said product is naturally aged.

6. The product of claim 1 wherein the maximum amount of Fe and Si present in said alloy are 0.10 and 0.12 weight percent, respectively.

7. The product of claim 1 wherein less than about 50% by weight of said alloy is recrystallized in said product after stretching.

8. The product of claim 1 wherein said alloy is characterized by a minimum ultimate tensile strength of at least about 66 ksi.

9. The product of claim 1 wherein said alloy is characterized by a volume fraction of less than about 1.5% of Fe, Si, Mg, Mn and Cu bearing intermetallic particles.

10. The product of claim 9 wherein said alloy is characterized by a volume fraction of from about 0.5% to about 1% of said particles.

11. A method for producing a plate product from an aluminum alloy, said product having high strength, high toughness and improved fatigue properties comprising the steps of providing an alloy consisting essentially of

| weight percent | element |
|---|---|
| 3.8 to 4.4 | Cu |
| 1.2 to 1.8 | Mg |
| 0.3 to 0.9 | Mn |

-continued

| weight percent | element |
|---|---|
| 0.12 maximum | Si |
| 0.15 maximum | Fe |
| 0.25 maximum | Zn |
| 0.15 maximum | Ti |
| 0.10 maximum | Cr |
| 0.05 maximum | each trace element |
| 0.15 maximum | total of trace elements |
| balance | Al, |

casting said alloy into a body, hot working said body to form a plate product, solution heat treating the alloy in said product such that the maximum amount of Cu is taken into solid solution during the solution heat treating step;

quenching said product, preaging said alloy at room temperature, thereafter cold rolling said product to reduce the thickness of said product, and thereafter stretching said product to relieve residual stresses in said product.

12. The method of claim 11 wherein said alloy is preaged at least about four hours prior to cold rolling said product.

13. The method of claim 12 wherein said alloy is preaged from about four to about ten hours.

14. The method of claim 11 further comprising the step of naturally aging said product.

15. The method of claim 11 wherein the maximum amount of Fe and Si present in said alloy are 0.10 and 0.12 weight percent, respectively.

16. The method of claim 12 wherein said alloy is reduced in thickness from 9% to 13% by cold rolling.

17. The method of claim 12 wherein less than about 50% by volume of said alloy is recrystallized after stretching said product.

18. The method of claim 11 wherein the Cu, Mn, Mg, Fe and Si levels in said alloy are adjusted to maintain the volume fraction of the intermetallic particles containing Cu, Mg, Mn, Fe and Si below about 1.5% of the total volume of said alloy.

19. The method of claim 18 wherein the volume percent of said particles is maintained between about 0.5% and about 1.0%.

20. The method of claim 11 wherein said alloy is characterized by a minimum ultimate tensile strength of at least about 66 ksi.

21. An extruded product produced from an Al-Cu-Mg alloy having high strength and toughness and improved fatigue properties, consisting essentially of

| weight percent | element |
|---|---|
| 3.8 to 4.4 | Cu |
| 1.2 to 1.8 | Mg |
| 0.3 to 0.9 | Mn |
| 0.12 maximum | Si |
| 0.15 maximum | Fe |
| 0.25 maximum | Zn |
| 0.15 maximum | Ti |
| 0.10 maximum | Cr |
| 0.05 maximum | each trace element |
| 0.15 maximum | total of trace elements |
| balance | Al, |

said alloy being hot worked to yield an extruded product having a substantially unrecrystallized structure.

22. The product of claim 21 wherein said product is stretched to relieve residual stresses in said alloy.

23. The product of claim 21 wherein said alloy is characterized by a volume fraction of less than about 1.5% of Fe, Si, Mg, Mn and Cu bearing, large, intermetallic constituent particles.

24. The product of claim 21 wherein said product is naturally aged.

25. The product of claim 22 wherein less than about 20% by volume of said alloy is recrystallized after heat treating and stretching said product.

26. The product of claim 23 wherein said alloy is characterized by a volume fraction of from about 0.5% to about 1% of said constituent particles.

27. A method for producing an extruded product from an aluminum alloy, said product having high strength, high toughness and improved fatigue properties comprising the steps of providing an alloy consisting essentially of

| weight percent | element |
|---|---|
| 3.8 to 4.4 | Cu |
| 1.2 to 1.8 | Mg |
| 0.3 to 0.9 | Mn |
| 0.12 maximum | Si |
| 0.15 maximum | Fe |
| 0.25 maximum | Zn |
| 0.15 maximum | Ti |
| 0.10 maximum | Cr |
| 0.05 maximum | each trace element |
| 0.15 maximum | total of trace elements |
| balance | Al, |

casting said alloy into a body, entruding said body into an extruded product at a temperature effective to maintain the alloy in said body in a substantially unrecrystallized state, solution heat treating the alloy in said product such that the maximum amount of Cu is taken into solid solution during the heat treatment step, quenching said product.

28. The method of claim 27 further comprising the step of stretching said product after quenching said product.

29. The method of claim 27 wherein the Cu,Mn,Mg,Fe, and Si levels in said alloy are adjusted to maintain the volume fraction of the intermetallic particles containing Cu, Mn, Mg, Fe and Si below about 1.5% of the total volume of said alloy.

30. The method of claim 27 further comprising the step of naturally aging said product.

31. The method of claim 28 wherein less than about 20% by volume of said alloy is recrystallized after stretching said product.

32. The method of claim 29 wherein the volume fraction of said particles is maintained between about 0.5% and about 1.0%.

33. An aluminum alloy product having high strength, high toughness, and improved fatigue properties consisting essentially of

| weight percent | element |
|---|---|
| 3.8 to 4.4 | Cu |
| 1.2 to 1.8 | Mg |
| 0.3 to 0.9 | Mn |
| 0.12 maximum | Si |
| 0.15 maximum | Fe |
| 0.25 maximum | Zn |
| 0.15 maximum | Ti |
| 0.10 maximum | Cr |
| 0.05 maximum | each trace element |
| 0.15 maximum | total of trace elements |
| balance | Al, |

casting said alloy into a body, solution heat treating the alloy in said product such that the maximum amount of Cu is taken into solid solution during the solution heat treating step, and quenching said product, said product having a substantially unrecrystallized structure.

* * * * *